US008122938B2

(12) United States Patent
Luce et al.

(10) Patent No.: US 8,122,938 B2
(45) Date of Patent: Feb. 28, 2012

(54) STATIONARY SIDE DAM FOR CONTINUOUS CASTING APPARATUS

(75) Inventors: Edward Luce, Kingston (CA); Eric Lees, Harrowsmith (CA); Kevin Gatenby, Kingston (CA); Daniel Godin, Trois Rivieres (CA); Rejean Leblanc, Jonquiere (CA)

(73) Assignee: Novelis Inc., Toronto (CA)

( * ) Notice: Subject to any disclaimer, the term of this patent is extended or adjusted under 35 U.S.C. 154(b) by 49 days.

(21) Appl. No.: 12/661,862

(22) Filed: Mar. 24, 2010

(65) Prior Publication Data

US 2010/0243194 A1 Sep. 30, 2010

Related U.S. Application Data

(60) Provisional application No. 61/211,277, filed on Mar. 27, 2009.

(51) Int. Cl.
*B22D 11/103* (2006.01)

(52) U.S. Cl. ..... 164/429; 164/432; 164/440

(58) Field of Classification Search ..... 164/429, 164/432, 440
See application file for complete search history.

(56) References Cited

U.S. PATENT DOCUMENTS

| | | | | |
|---|---|---|---|---|
| 3,036,348 | A | 5/1962 | Hazelett et al. | |
| 4,061,178 | A | 12/1977 | Sivilotti et al. | |
| 4,727,925 | A | 3/1988 | Asari et al. | |
| 4,794,978 | A * | 1/1989 | Lauener | 164/431 |
| 4,869,310 | A | 9/1989 | Yanagi et al. | |
| 5,671,800 | A | 9/1997 | Sulzer et al. | |
| 5,787,968 | A * | 8/1998 | Lauener | 164/481 |
| 6,095,383 | A | 8/2000 | Smith | |
| 6,363,999 | B1 | 4/2002 | Smith | |
| 2007/0267168 | A1 * | 11/2007 | Schueren | 164/480 |
| 2008/0115906 | A1 | 5/2008 | Peterson | |

FOREIGN PATENT DOCUMENTS

| | | |
|---|---|---|
| JP | 60-049841 A | 3/1985 |
| JP | 61-0132243 A | 6/1986 |
| JP | 1122638 A | 5/1989 |

OTHER PUBLICATIONS

U.S. Appl. No. 12/661,838, filed Mar. 24, 2010, Godin et al.
U.S. Appl. No. 12/661,861, filed Mar. 24, 2010, Godin et al.
Patent Abstracts of Japan, 01-122638, "Apparatus for Holding Belt in Belt Type Continuous Casting Machine", May 15, 1989, B22D 11/06, Yamane Atsumu, Nishimura Osamu and Shozen Kanji.

* cited by examiner

*Primary Examiner* — Jessica L Ward
*Assistant Examiner* — Nicholas D'Aniello
(74) *Attorney, Agent, or Firm* — Cooper & Dunham LLP

(57) ABSTRACT

Exemplary embodiments of the invention provide a side dam for a continuous metal casting apparatus having elongated opposed casting surfaces forming a casting cavity. The side dam has an elongated upstream part and an elongated downstream part that are mutually laterally pivotable, and a smooth metal-contacting side surface extending continuously from an upstream end to a downstream end of the side dam. The surface has regions thereof formed on the upstream part and the downstream part. Mutual pivoting of the upstream part and the downstream part of the side dam enables the regions of the smooth metal-contacting side surface to be moved out of mutual coplanar alignment. The side dams can therefore be used to form either a convergent or divergent casting cavity to assists the casting procedure and to enhance the properties of the cast article.

27 Claims, 4 Drawing Sheets

STATIONARY SIDE DAM FOR CONTINUOUS CASTING APPARATUS

CROSS-REFERENCE TO RELATED APPLICATION

This application claims the priority right of prior provisional application Ser. No. 61/211,277 filed Mar. 27, 2009 by applicants named herein. The entire contents of application Ser. No. 61/211,277 are specifically incorporated herein by this reference.

BACKGROUND OF THE INVENTION (1) Field of the Invention

This invention relates to the casting of metal strip articles by means of continuous strip casting apparatus of the kind that employ continuously moving elongated casting surfaces and side dams that confine the molten and semi-solid metal to the casting cavity formed between the moving casting surfaces. More particularly, the invention relates to the side dams themselves, and particularly, but not exclusively, to those intended for the casting of aluminum and alloys thereof.

(2) Description of the Related Art

Metal strip articles (such as metal strip, slab and plate), particularly those made of aluminum and aluminum alloys, are commonly produced in continuous strip casting apparatus. In such apparatus, molten metal is introduced between two closely spaced (usually actively cooled) elongated moving casting surfaces forming a casting cavity, and is confined within the casting cavity until the metal solidifies (at least sufficiently to form an outer solid shell). The solidified strip article, which may be produced in indefinite length, is continuously ejected from the casting cavity by the moving casting surfaces. One form of such apparatus is a twin-belt caster in which two confronting belts are rotated continuously and molten metal is introduced by a launder or injector into a thin casting cavity or mold formed between the confronting regions of the belts. An alternative is a rotating block caster in which the casting surfaces are formed by blocks that move around fixed paths and align with each other within the casting cavity. In both kinds of apparatus, the molten metal is introduced at one end of the apparatus, conveyed by the moving belts or blocks for a distance effective to solidify the metal, and then the solidified strip emerges from between the belts or blocks at the opposite end of the apparatus.

In order to confine the molten and semi-solid metal within the casting cavity, i.e. to prevent the metal escaping laterally from between the casting surfaces, it is usual to provide metal dams at each side of the apparatus. For twin-belt and rotating block casters, side dams of this kind can be formed by a series of metal blocks joined together to form a continuous line or chain extending in the casting direction at each side of the casting cavity. These blocks, normally referred to as side dam blocks, are trapped between and move along with the casting surfaces and are recirculated so that blocks emerging from the casting cavity exit move around a guided circuit and are fed back into the entrance of the casting cavity. The blocks are guided around this circuit by means of a metal track, or similar guide, on which the blocks can slide in a loose fashion that allows for limited movement between the blocks, especially as they move around curved parts of the circuit outside the casting cavity.

A problem with side dams made of blocks of this kind is that it is sometimes desired to change the through-thickness convergence of the belts, i.e. to make the casting cavity thinner at its exit than at its entrance (referred to as convergent) in order to extract more heat from the metal slab, or alternatively, to make the casting cavity thicker at the exit (referred to as divergent) in order to extract less heat from the metal slab. A requirement that the belts also drive the side dam blocks through the casting cavity may limit the extent to which the casting belts can be changed in this way.

The casting belts or blocks extract heat from the molten metal passing through the casting cavity, but heat is also extracted at the sides of the cavity where the molten metal contacts the side dam blocks which are usually made of a heat conductive material such as cast iron or mild steel. This heat extraction at the sides of the cavity often changes the microstructure and thickness of the slab in those areas, resulting in undesirable side-to-center non-uniformity of the cast metal slab.

U.S. Pat. No. 4,869,310 issued to Yanagi et al. on Sep. 26, 1989 discloses a twin-belt casting apparatus having side dams provided by moving side dam blocks as explained above. For comparison with the moving side dam blocks, however, this patent also shows the use of fixed side dams in FIGS. 7 and 8 of the patent. These fixed side dams extend for the full length of the casting cavity and are said to be liable to cause seizure when the metal solidifies. Also, it is said that a change in the width of the cast piece is not possible when such fixed side dams are employed.

There is therefore a need to address the problems mentioned above.

BRIEF SUMMARY OF THE INVENTION

According to one exemplary embodiment, there is provided a side dam for a continuous metal casting apparatus having elongated opposed casting surfaces forming a casting cavity therebetween. The side dam comprises an elongated upstream part and an elongated downstream part that are mutually laterally pivotable, and a smooth metal-contacting side surface extending continuously from an upstream end to a downstream end of the side dam. The side surface has regions thereof formed on the upstream part and the downstream part, whereby mutual pivoting of the upstream part and the downstream part of the side dam enables the regions of the smooth metal-contacting side surface to be moved out of mutual coplanar alignment.

The smooth continuous surface is preferably an outer surface of an elongated strip of flexible refractory material extending continuously from the upstream end to the downstream end of the side dam, and the strip is preferably made of a material that has a coefficient of friction with molten metal such that the metal does not build up on the surface as the metal solidifies during casting. For example, the elongated strip may be made of flexible graphite composition. Preferably, the elongated strip stands proud (e.g. by a distance of up to about 1 mm) of the remainder of the upstream and downstream parts of the side dam at the surfaces thereof that, in use, confront the casting surfaces of the continuous casting apparatus. Ideally, the remainder of the surfaces of the side dam that, in use, confront the casting surfaces have a coating of a refractory low friction wear-resistant material (e.g. a metal nitride, such as boron nitride).

The side dam may have a layer of heat insulating material (e.g. refractory insulating board) adjacent to the elongated flexible strip. This reduces heat loss from the metal being cast into the fabric of the side dam. The side dam may also have an elongated backing element made of rigid material (preferably a metal such as steel) along a side of the upstream and/or downstream parts opposite to the metal-contacting side surface of the side dam.

The side dam preferably also has at least one anchor point (which may be a hold for a bolt, a region for application of adhesive, an attachment bracket, or the like) adjacent to the upstream end for rigid attachment of the side dam to an element of the continuous metal casting apparatus. This prevents the side dams from being dragged in the casting direction by the casting surfaces.

The side dam preferably has a hinge acting between the upstream and downstream parts thereof, the hinge enabling and guiding the mutual pivoting of the parts. The hinge may be a door-type hinge made of the material of the backing element, or it may simply be a web of flexible material adhered or otherwise attached to each part of the side dam.

The side dam preferably has a length from the upstream end to the downstream end that is less than the length of a casting cavity of a continuous casting apparatus with which the side dam is used, but greater than the downstream extent of molten and semi-solid metal cast in the apparatus. The side dam therefore merely covers the distance over which metal may leak or flow from the casting cavity.

Another exemplary embodiment provides a continuous metal casting apparatus comprising opposed rotating casting surfaces forming a casting cavity therebetween, a metal inlet for introducing molten metal into the cavity, and two side dams for confining molten metal to the casting cavity. At least one of the two side dams (and preferably both) comprises an elongated upstream part and an elongated downstream part that are mutually laterally pivotable, and a smooth metal-contacting side surface extending continuously from an upstream end to a downstream end of the side dam and having regions thereof formed on the upstream part and the downstream part, whereby mutual pivoting of the upstream part and the downstream part of the side dam enables the regions of the smooth metal-contacting side surface to be moved out of mutual coplanar alignment.

In the casting apparatus, the casting surfaces are preferably surfaces of a pair of opposed rotating casting belts or, alternatively, surfaces of a series of rotating casting blocks. The metal inlet is preferably a molten metal injector having a nozzle projecting between the opposed casting surfaces, and wherein at least one of the side dams is attached to the nozzle, either to the outer surface of the nozzle or the inner surface thereof.

In the casting apparatus, the upstream and downstream part of the side dam is preferably arranged at a convergent angle, or a divergent angle, and most preferably the latter, relative to a casting direction of the metal. This angle is preferably 10° or less.

Another exemplary embodiment provides a continuous metal casting apparatus comprising opposed rotating casting surfaces forming a casting cavity therebetween, a metal inlet for introducing molten metal into the cavity, and two side dams for confining molten metal to the casting cavity, wherein at least one of the two side dams comprises a flexible elongated strip of low friction refractory material that is resistant to attack by molten metal, the flexible elongated strip having a metal-contacting side and an opposed side, an elongated block of heat insulating material contacting the opposed side of the flexible elongated strip, the elongated block having a surface remote from the flexible elongated strip, and a backing element of rigid material contacting the remote surface of the elongated block, wherein the flexible elongated strip, the elongated block and the backing element fit between the opposed casting surfaces adjacent to the metal inlet thereof in contact with both of the opposed casting surfaces.

While the exemplary embodiments are particularly suited for use with, or the casting of, aluminum or aluminum alloys, it is also possible to cast other metals in the same way, e.g. copper, lead and zinc, and even magnesium and steel.

BRIEF DESCRIPTION OF THE SEVERAL VIEWS OF THE DRAWINGS

Exemplary embodiments of the invention are described in detail in the following with reference to the accompanying drawings, in which.

DETAILED DESCRIPTION OF THE EXEMPLARY EMBODIMENTS

The exemplary embodiments of this invention described in the following are directed in particular for use with twin belt casters, e.g. of the kind disclosed in U.S. Pat. No. 4,061,178 issued to Sivilotti et al. on Dec. 6, 1977 (the disclosure of which is incorporated herein by reference). However, other exemplary embodiments may be used with casters of other kinds, e.g. rotating block casters. Twin belt casters have an upper flexible belt and a lower flexible belt that rotate about rollers and/or stationary guides. The belts confront each other for part of their length to form a thin casting cavity or mold having an entrance and an exit. Molten metal is fed into the entrance and a cast metal slab emerges from the exit. Cooling water sprays are directed onto the interior surfaces of the belts in the region of the casting cavity for the purpose of cooling the metal. The molten metal may be introduced into the casting cavity by means of a launder, but it is more usual to provide an injector that projects partially into the casting cavity between the belts at the entrance. Exemplary embodiments may be used most preferably with a type of metal injector having a flexible nozzle as disclosed in U.S. Pat. No. 5,671,800 issued to Sulzer et al. on Sep. 30, 1997 (the disclosure of which is incorporated herein by reference).

Figure 1:
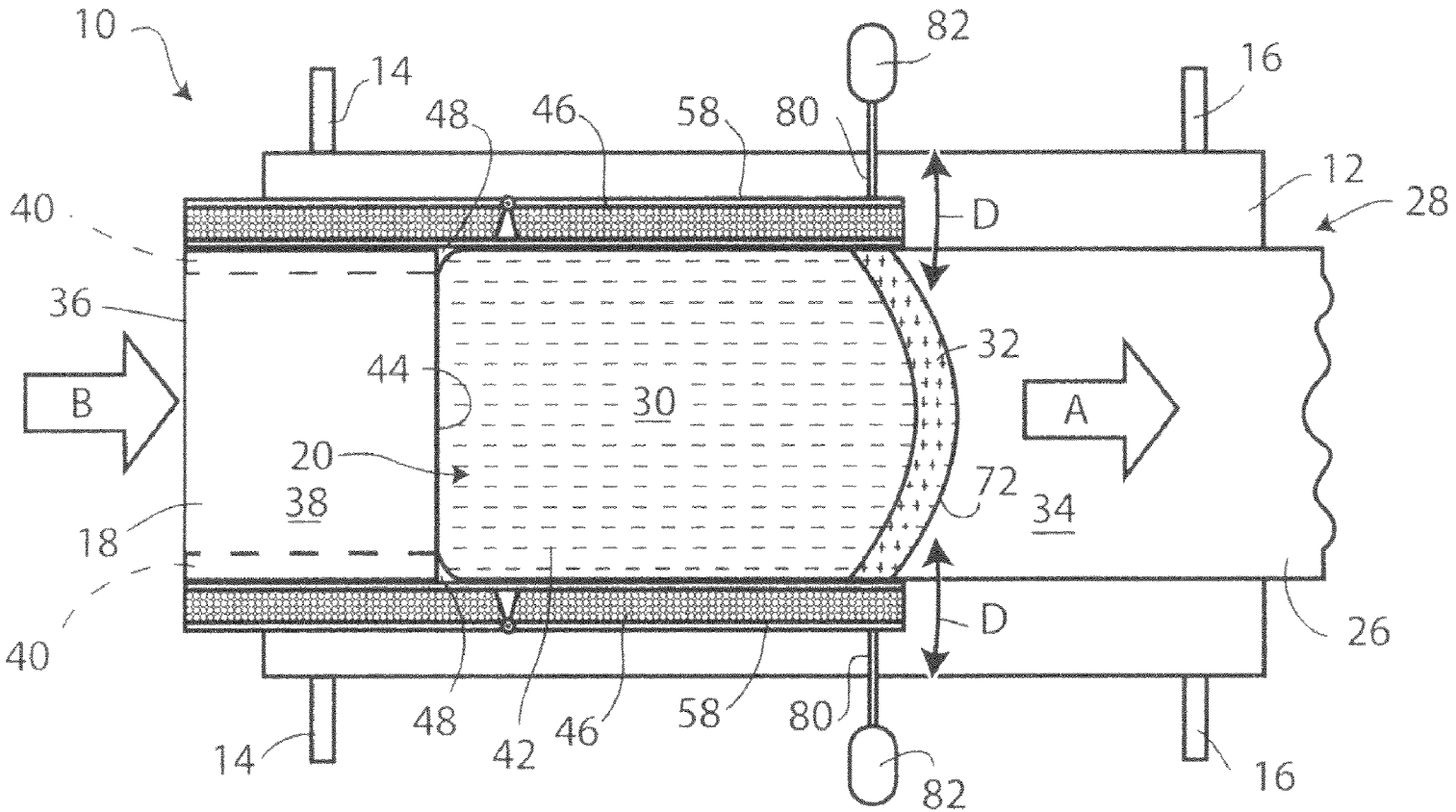
FIG. 1 is a top plan view of a twin-belt casting apparatus with the top belt removed to show side dams according to an exemplary embodiment.
Figure 2:
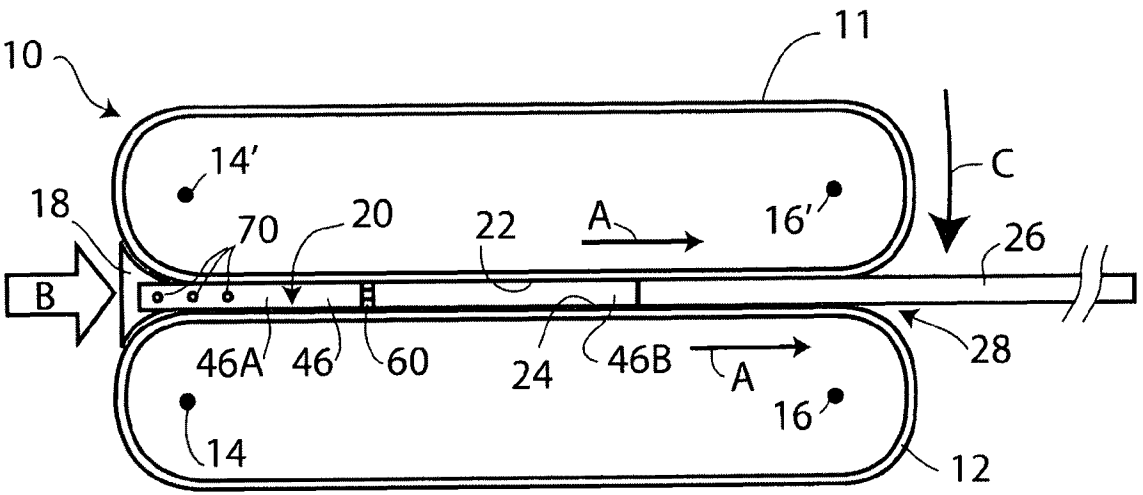
FIG. 2 is a simplified side view of a twin belt casting apparatus showing a side dam of the kind illustrated in FIG. 1.

FIG. 1 of the accompanying drawings is a top plan view of a twin belt casting apparatus 10 with a top belt removed illustrating a casting operation in progress. FIG. 2 is a simplified schematic side view of the same apparatus with both rotating casting belts 11 and 12 shown in place. The lower belt 12 is visible in FIG. 1 and it rotates around axes 14 and 16 in the direction of arrow A (the casting direction). Similarly, the upper belt (not visible in FIG. 1) rotates in the opposite sense around axes 14' and 16'. Molten metal 42 (e.g. an aluminum alloy) is introduced into the apparatus at an upstream entrance as represented by arrow B and it passes through a molten metal injector 18 into a casting cavity 20 formed between opposing elongated surfaces 22 and 24 (see FIG. 2) of the upper belt 11 and the lower belt 12. The molten metal is conveyed in the direction of arrow A by the rotating belts and it eventually solidifies to form a strip article 26 in the form of a cast slab of indefinite length that emerges from the apparatus at an exit 28 where the belts 11, 12 change direction as they circulate around their defined paths. In the case of many metals (particularly aluminum alloys), the metal becomes semi-solid while transforming from the fully molten to the fully solid state. Consequently, the metal in the casting cavity has a molten region 30, a semi-solid region 32 and a fully solid region 34 as it proceeds from injector 18 to exit 28. The semi-solid region 32 is somewhat curved as shown because heat tends to be extracted more slowly at the center of the cast slab than at the sides.

The injector 18 has a metal-conveying channel 36 formed between upper and lower walls 38, 39 (only the upper wall 38 is visible in FIG. 1, but both are visible in FIG. 6) held apart by side walls 40 represented by broken lines in FIG. 1. The molten metal 42 emerges into the casting cavity between the belts through an end opening or nozzle 44 at the downstream end of the injector 18, and the molten metal is laterally confined between a pair of stationary side dams 46 until it is fully solid and self-supporting. Because the side walls 40 of the injector 18 have substantial lateral width, the molten metal initially flows laterally (as well as forwardly) to contact the side dams 46 as it emerges from nozzle 44 as shown at 48.

Figure 3:
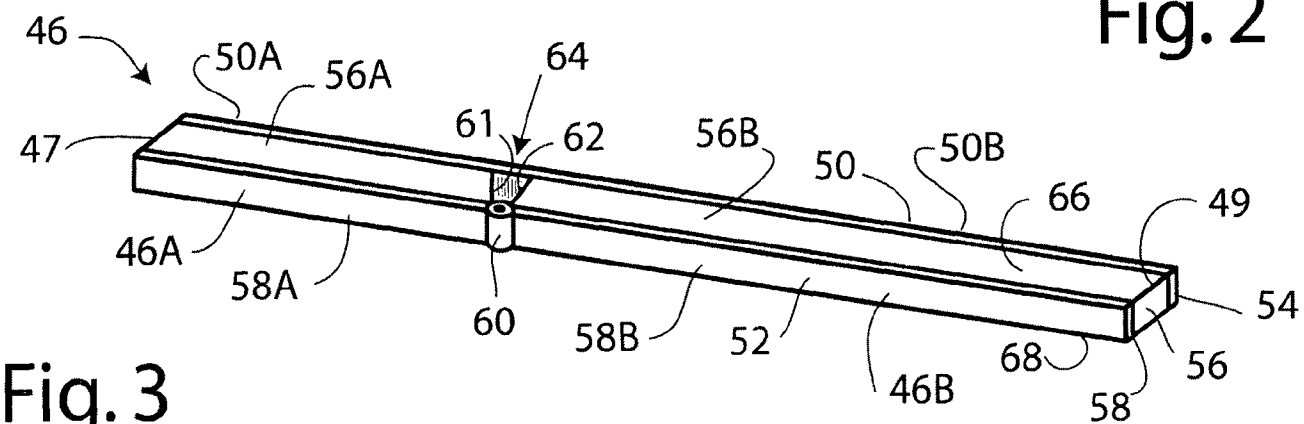
FIG. 3 is a perspective view of a side dam, shown in isolation, according to an exemplary embodiment.

One of the side dams 46 is shown in isolation in FIG. 3. The side dam has an upstream end 47 and a downstream end 49, and a smooth unbroken metal-contacting surface 50 that extends continuously between the upstream and downstream ends of the side dam. The other lateral side of the side dam has an opposed outer surface 52. The metal-contacting surface 50 is formed by an outer surface of a flexible elongated strip 54 made of flexible preferably low friction refractory material that is able to resist attack by the molten metal and resists the build-up of solidified metal during casting. The material is preferably a flexible graphite composition, e.g. a material sold under the trademark Grafoil® by American Seal and Packing (a division of Steadman & Associates, Inc.) of Orange County, Calif., USA. However, other materials that have non-wetting, non-reacting, low heat transfer, high wear-resistant and low friction properties may be employed, e.g. carbon-carbon composites, refractory board having a coating of boron nitride, and solid boron nitride. The strip 54 is backed by an elongated block 56 of heat insulating material, e.g. refractory board. This may be the same kind of material from which the injector 18 is made, or a different material, e.g. the material available from Carborundum of Canada Ltd. as product no. 972-H refractory sheet. This is a felt of refractory fibers typically comprising about equal proportions of alumina and silica and usually containing some form of rigidizer, e.g. colloidal silica, such as Nalcoag® 64029. The elongated block 56 is formed in two parts, i.e. an upstream part 56A and a downstream part 56B. Thus, the side dam block is also formed in two parts except for the strip 54 that extends without break and bridges the junction between the two parts 56A and 56B of the underlying block 56. The metal-contacting surface 50 thus has an upstream region 50A formed on part 56A of the elongated block 56 and a downstream region 50B formed on part 56B of the elongated block. The block 56 is itself backed by a rigid backing element 58 made, for example, of steel or other metal, and it too is formed in two parts 58A and 58B joined together by a vertical-axis hinge 60. The hinge 60 allows the upstream and downstream parts of the block 56 to be mutually pivotable so that the upstream and downstream regions of the metal-contacting surface 50 may be moved out of the mutually coplanar alignment that they have when the side dam is perfectly straight. This pivoting is accommodated by oblique surfaces formed at inner ends 61 and 62 of the parts 56A and 56B of the insulating block 56 which together create a V-shaped opening 64, and also by the flexible nature of the strip 54 which allows bending of this element in the region of the opening 64. The flexible strip, insulating block and backing element are securely attached to each other, e.g. by mechanical fasteners (not shown). Such fasteners preferably attach the flexible strip 54 with a certain amount of longitudinal play relative to the adjacent insulating block 56 (either in region 56A or region 56B or both) so that part 46B of the side dam may be pivoted clockwise (referring to FIG. 3) without causing the flexible strip to stretch at the opening 64 (since pivoting in this direction cannot be accommodated by flexing alone, as it can be for pivoting in the anti-clockwise direction).

Figure 4:
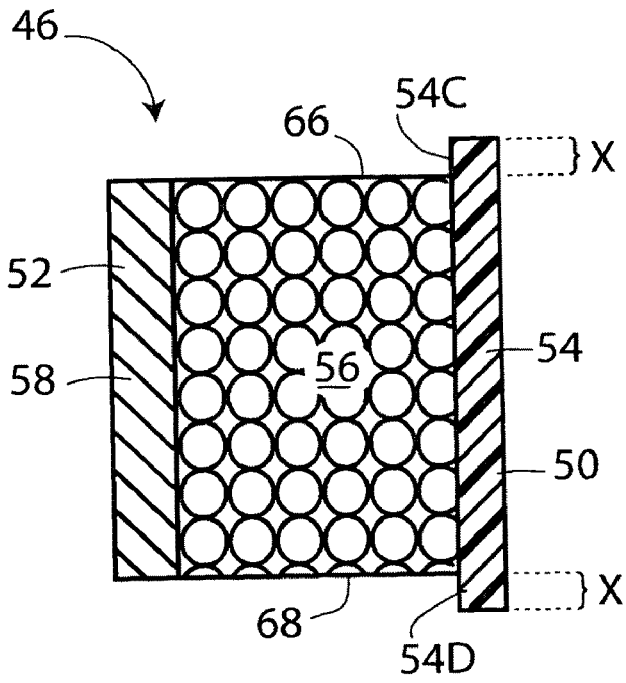
FIG. 4 is a vertical transverse cross-section of the side dam of FIG. 3 taken between an upstream and a downstream end thereof.

The side dams 46 remain stationary in the casting apparatus and the low friction property of the flexible elongated strip 54 resists any tendency of the moving metal to stick or jam against the side dam 46 as it solidifies and is carried forwards by the belts. The elongated strip 54 is dimensioned to contact both of the casting belts and the flexible nature of the strip allows it to yield to the shape of the belt and to form a good seal against molten metal outflow. The low friction properties of the strip reduce frictional drag from the belts as they move over the side dam. To facilitate the formation of the seal, the strip may stand proud of the remainder of upper and lower surfaces 66 and 68 of the side dam by a small amount (e.g. up to about 1 mm). This is shown in FIG. 4 of the drawings, which is a transverse vertical section through the side dam mid-way between its upstream and downstream ends. The flexible strip 54 has upper and lower ends 54C and 54D that stand proud by a distance "X" from the remainder of the upper surface 66 and lower surface 68. In order to further reduce frictional drag on the side dam from the belts, the remainder of the upper and lower surfaces 66 and 68 of the side dam may be coated with a low friction material (not shown) such as a metal nitride (e.g. boron nitride).

It should be mentioned here that, although the previous description refers to the formation of a good seal between the strip 54 and the casting belts (which is preferred), there may in fact be a gap of up to about 1 mm between the strip 54 (or the highest part of surfaces 66, 68) and the adjacent surfaces of the casting belts without loss of metal. This is because the molten metal has a degree of surface tension that creates a meniscus that bridges gaps up to about 1 mm without penetration through such gaps. Direct and firm contact between the side dam and the metal surfaces is therefore not essential. The provision of a gap in this way makes it possible, for example, to accommodate a convergence of the casting belts between the entrance and the exit. That is to say, the side dam 46 may not quite touch the casting belts in the region of the nozzle 44 but may gently touch the belts adjacent to the downstream end 49 due to convergence of the belts. The flexibility of the strip 54 may accommodate further belt convergence because the parts that stand proud may compress, thus decreasing the distances X. If even further convergence of the belts is to be accommodated, the side dam 46 may be made to taper down in height from the upstream end 47 to the downstream end 49. In contrast, it may be desirable in some cases to arrange the casting cavity to diverge in the casting direction, and this can correspondingly be accommodated by providing a slight spacing between side wall and belts at the downstream end, and/or by making the sidewall taper up in height from the upstream to the downstream ends.

The elongated flexible strip 54 and the insulating block 56 are preferably made of heat insulating material and thus have low thermal mass and low thermal conductivity (much lower than the metal of conventional side dam blocks) so that very little heat is withdrawn from the metal slab at the sides allowing the metal to cool uniformly across the slab width to provide more uniform solid microstructure and thickness. Furthermore, the heat insulating property means that the metal tends not to freeze on the elongated flexible layer 54 as little heat is withdrawn through this layer. Any metal that does freeze directly onto the flexible strip is easily carried away by the remainder of the moving slab because of the low friction properties of the strip. Therefore, solid metal tends not to build up on the stationary side dams.

The rigid backing element 58 serves to protect and support the other elements of the side dam since these other parts may be rather delicate and easily damaged. This element 58 also forms a solid base that allows the side dam to be anchored rigidly in place on the casting apparatus and, due to its relatively high heat capacity, serves to freeze and contain molten metal in the event of failure of the remainder of the side dam.

In the embodiment of FIGS. 1 and 2, the side dams 46 are anchored to the side walls of the molten metal injector 18, e.g. by means of bolts 70 (FIG. 2) or by other means. Holes for the bolts may be pre-drilled into the side dam to provide anchor points, or other means of attachment may be provided. This attachment prevents the side dams from being moved in the casting direction by contact with the rotating casting belts. The side dams preferably extend from the injector 18 to a position just downstream of the points where the metal slab becomes fully solid at the side edges of the slab (i.e. just beyond solidus line 72 of FIG. 1). The side dams may be made to extend further along the casting cavity, if desired, but there is no advantage in doing so because the solid metal requires no further lateral confinement beyond the solidus line 72 and side dams of greater length merely generate more friction with the belts and are more expensive to manufacture. Moreover, as will be appreciated from the comments above regarding cavity convergence and divergence, an advantage of the illustrated embodiment is that the termination of the side dams short of the end of the casting cavity makes it possible to vary the depth (i.e. the through-thickness) of the casting cavity towards the exit 28 more extensively without interference from the side dams. This makes it possible to vary heat removal from the metal slab for greater or lesser cooling by the cooled casting belts. For example, by moving the downstream end of the upper casting belt 11 as shown by arrow C in FIG. 2, the casting cavity can be made to converge towards the exit 28. Greater amounts of such variation may be accommodated in the illustrated embodiment than in a conventional casting apparatus because (a) termination of the side dam short of the cavity exit permits greater variation of the angle between upper and lower casting surfaces, and (b) small variations in the height of the casting surface even at positions where the side dam is present may be accommodated because of the possibility of providing a small gap and also because of the flexible and compressible nature of the elongated strip 54 which extends slightly upwardly from the upper surface 66 of the remainder of the side dam 46, as previously explained.

The distance along the casting cavity that the side dams 46 are required to extend beyond the injector 18 depends on the length of the region 30 of molten metal and the region 32 of semi-solid metal (referred to, in combination, as the molten metal "sump"). This, in turn, depends on the characteristics of the alloy being cast, the casting speed and the thickness of the slab being cast. Table 1 below provides typical working and preferred ranges for common aluminum alloys.

TABLE 1

| | Working Range | Preferred Range | Most Preferred |
|---|---|---|---|
| Slab Thickness (mm) | 5-100 | 8-25 | |
| Casting Speed (m/min) | 0.5-20 | 2-10 | |
| % Protrusion along Cavity | 5-100 | 20-75 | 35-75 |

As noted above, the side dams 46 are each provided with a hinge 60 that permits articulation between an upstream part 46A of the side dam and a downstream part 46B. The upstream parts 46A are securely attached to the (normally parallel) sides of the injector 18 and are thus parallel and extend in the casting direction without sideways divergence or convergence. However, the downstream parts 46B can be rotated about hinge 60 as shown by arrows D in FIG. 1. It is therefore possible to accommodate any misalignment of the upstream part and/or to make the casting cavity slightly convergent or slightly divergent. The angle of the downstream parts of the side dams relative to the casting direction (arrow A) should preferably not be made too convergent or the moving solidified slab will bear too firmly against the flexible strip 54 and possibly damage it. On the other hand, the angle should preferably not be made too divergent or the molten metal may escape from the casting cavity by leaking between the flexible strip 54 and the slab along the casting direction. However, the angle can be made optimal to accommodate the flow of metal. For example, it is normally found that a slight outward flare (divergence) reduces drag on the flexible strip from the solidifying slab, particularly around the semi-solid region 32. In general, the working range of movement of the lower part 46B of the side dam is 10° or less (i.e. 5° or less on each side of the casting direction). In practice, a range of up to 2-3° on each side of the casting direction is usual which, for a side dam of normal length, may mean a movement of downstream end 49 by approximately up to 2-5 mm to each side of the casting direction. For example, for a side dam having a downstream part of 0.5 m in length, a rotation of 3 mm at the downstream end 49 corresponds to an angle (from the straight line casting direction) of 0.34°, and for a downstream part 0.25 m in length, 3 mm of motion corresponds to an angle of 0.5°. The hinge 60 may be positioned at any point between the nozzle 18 and the end of the molten region 30 at the side of the slab, but is normally positioned part way or about mid-way, as shown in FIGS. 1 and 4.

The angle of the downstream part 46B of the side dam 46 relative to the casting direction may be set before casting commences or may be adjusted during casting when the effect of the adjustment or the need for it (e.g. molten metal leakage around the slab) can be observed. The low friction characteristics of the elongated strip 54 and the low friction coating (if any) provided on the remainder of the upper and lower surfaces 66, 68 of the side dam allow the downstream part to be moved as the casting apparatus is in operation. This can be done in a precise manner by means of rods 80 attached to the backing elements 58 near the downstream ends thereof. The rods are precisely moved axially forwards or backwards by desired amounts either manually or by electric or hydraulic/pneumatic motors 82 (which may be under computer control).

Figure 5:
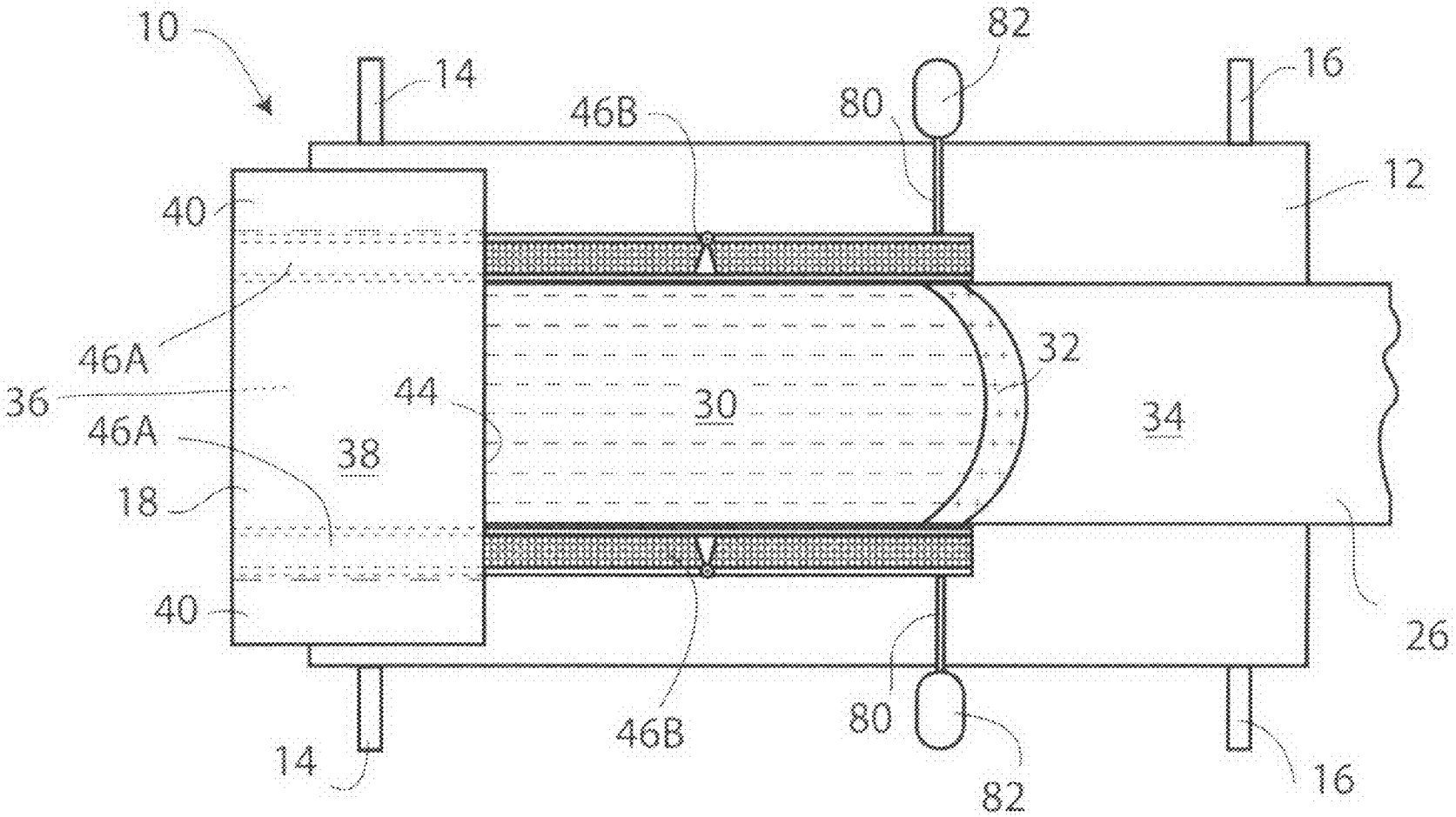
FIG. 5 is a top plan view similar to that of FIG. 1, but illustrating an alternative arrangement for positioning side dams according to another exemplary embodiment.

In the arrangement of FIG. 1, the molten metal flows from the nozzle 18 laterally to the side dams 46 at positions 48 as previously mentioned. This is necessary since the aperture at the nozzle 44 is narrower than the width of the casting cavity because of the thickness of the inside walls 40 of the injector 18. This lateral movement can give rise to eddy currents in the molten metal that may restrict smooth flow and have other consequences. To avoid this, the side dams 46 may be positioned partly within the injector as shown in FIG. 5. In this embodiment, the upstream parts 46A of the side dams are attached to the inner surfaces of the side walls 40, or other internal parts, of the injector 18 and preferably extend for the full distance from the injector inlet to the tip of nozzle 44, thereby providing a continuous smooth side wall extending within the injector and from there to and through the casting cavity, thereby providing a continuous smooth metal contacting surface 50 and eliminating any obstructions that may cause eddy currents or the like. Such an arrangement means that the width of the casting cavity exactly matches the width of the nozzle 44 so that there is no lateral movement of molten metal. Of course, in this embodiment, the lateral width of the injector 18 must be made larger than that of the injector of FIG. 1 to produce a casting a slab of the same width. However, this illustrates how the exemplary embodiments can be used to change the casting apparatus quickly to produce slabs of different widths by using just one injector and mounting the side dams either internally or externally for different casting runs. Alternatively, injectors of different widths may be substituted for one another, and the side dams may be mounted exclusively externally on each injector, exclusively internally on each injector or a mixture of internally and externally, in order to cast slabs of different widths to suit commercial demands.

Figure 6:
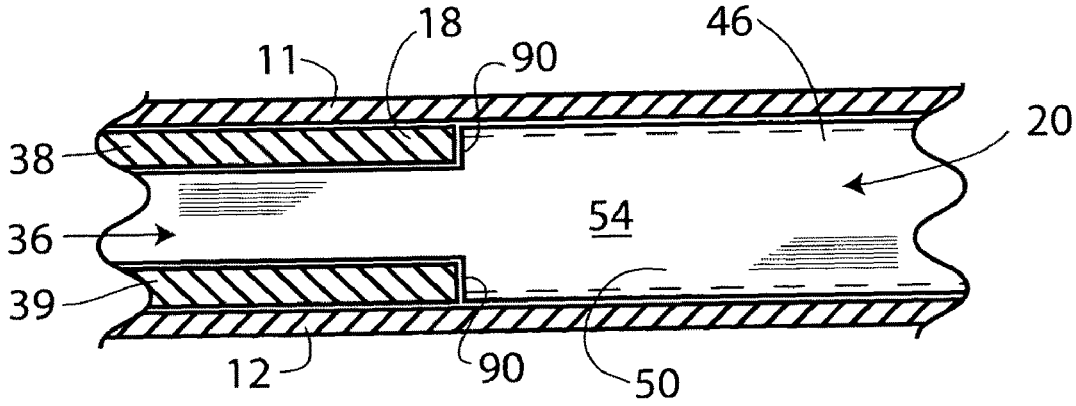
FIG. 6 (which appears on the same sheet of drawings as FIG. 4) is a vertical cross-section of the casting machine shown in FIG. 5 (but with molten metal omitted) showing only the region around the tip of the nozzle 18 and an immediately adjacent part of the casting cavity.

In the embodiment of FIG. 5, and as represented more clearly in FIG. 6, the height of the part of the side dam within the injector 18 may be less than the height of the side dam within the casting cavity by an amount that accommodates the thickness of the top wall 38 and bottom wall 39 of the injector. In other words, there is an upward or downward step 90 in the upper or lower surface of the side dam 46 at the point where the side dam leaves the injector so that the part of the side dam within the casting cavity has sufficient height to closely approach the casting surfaces and prevent leakage of molten metal above or below the side dam. Within the injector 18, the side dams extend substantially fully from the upper wall 38 to the lower wall of the injector, as shown.

In the above embodiments, the side dams comprise three elements, namely the flexible strip 54, the insulating block 56 and the backing element 58. However, it is not always necessary to provide all these elements. The metal-contacting surface of the side dam should preferably be made of or coated with a material that has low friction and good heat resistance. The friction properties should preferably be low enough to prevent solid metal build up on the side dam and wear that reduces the operational life of the side dam. The metal-contacting surface should also preferably be capable of flexing or bending to allow the downstream part of the side dam to be pivoted laterally relative to the upstream part without causing a break that could result in leakage of metal or solid metal build-up. The side dam should also preferably be heat insulating to reduce heat flux from the molten metal at the sides of the casting cavity. The degree of heat insulation should preferably be sufficient to avoid the formation of problematic micro-structural defects in the cast strip article and significant variations of thickness across the cast article. This heat insulation may be provided by an insulating block or by the material of the flexible strip itself (or both). The backing element 58 may be omitted if the other elements are sufficiently structurally rigid and durable to avoid undue damage during use and to allow secure attachment to the injector or other parts of the apparatus. The hinge 60 may be replaced by a flexible web of material attached to the upstream and downstream elements of the side wall, or may be omitted entirely if the flexible member is sufficiently strong to prevent tearing or fracture at the junction.

The illustrated embodiments provide longitudinally fixed but bendable (pivotable) side dams at both sides of the casting cavity. This is preferred to ensure that both sides of the cast slab are subjected to the same casting conditions. However, if desired, one of the fixed side dams may be non-bendable or, alternatively, one side of the cavity may be closed by movable blocks of the conventional kind, although then the benefits of convergence/divergence of the casting cavity would be unavailable because the moving blocks must necessarily extend for the full length of the casting cavity.

It is also to be noted that some casting machines do not have a molten metal injector 18 but are instead fed with molten metal via a launder (metal feeding trough) or similar no-tip, drag-out style metal feeding arrangement. In such a case, the stationary side dam is fixed to the caster frame or to the metal feeding trough as there can be no anchorage to the injector itself.

What we claim is:

1. A side dam for a continuous metal casting apparatus having elongated opposed casting surfaces advancing in a casting direction forming a casting cavity therebetween, the side dam comprising an upstream end and a downstream end, an elongated generally straight upstream part and an elongated generally straight downstream part that are mutually laterally pivotable at a point between said upstream end and said downstream end, at least one anchor point attachable to a fixed element of said casting apparatus to prevent the side dam from being dragged in said casting direction by said advancing casting surfaces, and a smooth metal-contacting side surface extending continuously from said upstream end to said downstream end of the side dam and having regions thereof formed on said upstream part and said downstream part, whereby mutual lateral pivoting of said upstream part and said downstream part of the side dam enables said regions of the smooth metal-contacting side surface to be moved out of mutual coplanar alignment wherein the smooth metal-contacting side surface continues to extend continuously from said upstream end to said downstream end of the side dam during pivoting and after said regions are moved out of mutual coplanar alignment.

2. The side dam of claim 1, wherein said smooth continuous surface is an outer surface of an elongated strip of flexible refractory material extending continuously from said upstream end to said downstream end of the side dam.

3. The side dam of claim 2, wherein said material has a coefficient of friction with molten metal such that said metal does not build up on said surface as said metal solidifies when cast.

4. The side dam of claim 2, wherein the elongated strip is made of flexible graphite composition.

5. The side dam of claim 2, wherein said elongated strip stands proud of a remainder of said upstream and downstream parts of the side dam at each longitudinal side of the elongated strip.

6. The side dam of claim 5, wherein said elongated strip stands proud by amounts of up to 1 mm.

7. The side dam of claim 5, wherein side surfaces of said remainder of the said upstream and downstream parts of the side dam adjacent to said strip have a coating of a refractory low friction wear-resistant material.

8. The side dam of claim 2, comprising a layer of heat insulating material adjacent to said elongated flexible strip opposite said metal-contacting side surface.

9. The side dam of claim 8, wherein said heat insulating material is a refractory insulating board.

10. The side dam of claim 1, having an elongated backing element of rigid material fully covering a side of said upstream and/or downstream part opposite to said metal-contacting side surface.

11. The side dam of claim 10, wherein said backing element is made of a metal.

12. The side dam of claim 11, wherein said metal is steel.

13. The side dam of claim 1, wherein said at least one anchor point is positioned adjacent to said upstream end.

14. The side dam of claim 1, having a hinge acting between said upstream and downstream parts thereof, said hinge enabling and guiding said mutual pivoting of said parts.

15. The side dam of claim 1, wherein a distance from said upstream end to said downstream end is less than a length of a casting cavity of a continuous casting apparatus with which said side dam is used, but greater than a downstream extent of molten and semi-solid metal cast in said apparatus.

16. A continuous metal casting apparatus comprising opposed casting surfaces advancing in a casting direction forming a casting cavity therebetween, a metal inlet for introducing molten metal into said cavity, and two side dams for confining molten metal to said casting cavity, wherein at least one of said two side dams has at least one anchor point attached to a fixed element of said casting apparatus to prevent said at least one side dam from being dragged in a casting direction by said advancing casting surfaces, and comprises an upstream end and a downstream end, an elongated generally straight upstream part and an elongated generally straight downstream part that are mutually laterally pivotable at a point between said upstream end and said downstream end, and a smooth metal-contacting side surface extending continuously from said upstream end to said downstream end of the side dam and having regions thereof formed on said upstream part and said downstream part, whereby mutual lateral pivoting of said upstream part and said downstream part of the side dam enables said regions of the smooth metal-contacting side surface to be moved out of mutual coplanar alignment wherein the smooth metal-contacting side surface continues to extend continuously from said upstream end to said downstream end of the side dam during pivoting and after said regions are moved out of mutual coplanar alignment.

17. The casting apparatus of claim 16, wherein another of said two side dams has at least one anchor point attached to a fixed element of said casting apparatus to prevent said another side dam from being dragged in a casting direction by said advancing casting surfaces, and comprises an upstream end and a downstream end, an elongated generally straight upstream part and an elongated generally straight downstream part that are mutually laterally pivotable at a point between said upstream end and said downstream end, and a smooth metal-contacting side surface extending continuously from said upstream end to said downstream end of the side dam and having regions thereof formed on said upstream part and said downstream part, whereby mutual lateral pivoting of said upstream part and said downstream part of the side dam enables said regions of the smooth metal-contacting side surface to be moved out of mutual coplanar alignment.

18. The casting apparatus of claim 16, wherein said at least one of said two side dams does not extend fully along said casting cavity from said metal inlet, but extends beyond a downstream extent of molten and semi-solid metal cast in said apparatus.

19. The casting apparatus of claim 16, wherein said casting surfaces are surfaces of a pair of opposed rotating casting belts.

20. The casting apparatus of claim 16, wherein said casting surfaces are surfaces of a series of rotating casting blocks.

21. The casting apparatus of claim 16, wherein said metal inlet is a molten metal injector having a nozzle projecting between said opposed casting surfaces, and wherein said at least one of said side dams is attached to said nozzle via said anchor point.

22. The casting apparatus of claim 21, wherein said at least one of said side dams is attached to an outer surface of said nozzle.

23. The casting apparatus of claim 21, wherein said at least one of said side dams is attached to an inner surface of said nozzle via said anchor point.

24. The casting apparatus of claim 17, wherein said upstream and downstream parts of said at least one of said side dams are arranged at a convergent angle relative to a casting direction of said metal.

25. The casting apparatus of claim 17, wherein said upstream and downstream parts of said at least one of said side dams are arranged at a divergent angle relative to a casting direction of said metal.

26. The casting apparatus of claim 24, wherein said convergent angle is 10° or less.

27. The casting apparatus of claim 25, wherein said divergent angle is 10° or less.

* * * * *